US011137722B2

(12) United States Patent
Mitamura

(10) Patent No.: US 11,137,722 B2
(45) Date of Patent: Oct. 5, 2021

(54) TIMEPIECE

(71) Applicant: CITIZEN WATCH CO., LTD., Nishitokyo (JP)

(72) Inventor: Noriaki Mitamura, Nishitokyo (JP)

(73) Assignee: Citizen Watch Co., Ltd., Nishitokyo (JP)

( * ) Notice: Subject to any disclaimer, the term of this patent is extended or adjusted under 35 U.S.C. 154(b) by 427 days.

(21) Appl. No.: 16/083,298

(22) PCT Filed: Mar. 7, 2017

(86) PCT No.: PCT/JP2017/008954
§ 371 (c)(1),
(2) Date: Sep. 7, 2018

(87) PCT Pub. No.: WO2017/154887
PCT Pub. Date: Sep. 14, 2017

(65) Prior Publication Data

US 2019/0086870 A1 Mar. 21, 2019

(30) Foreign Application Priority Data

Mar. 9, 2016 (JP) ..... JP2016-045722

(51) Int. Cl.
*G04B 19/26* (2006.01)
*G04B 19/08* (2006.01)
(Continued)

(52) U.S. Cl.
CPC ..... *G04B 19/268* (2013.01); *G04B 19/046* (2013.01); *G04B 19/065* (2013.01);
(Continued)

(58) Field of Classification Search
CPC .. G04B 19/268; G04B 19/247; G04B 19/085; G04B 19/065; G04B 19/26; G04B 19/046; G04B 19/202
(Continued)

(56) References Cited

U.S. PATENT DOCUMENTS 2,011,517 A * 8/1935 Geoffrion ..... G04B 19/00 368/233
4,681,459 A * 7/1987 Nabeyama ..... G04B 19/268 273/161
(Continued)

FOREIGN PATENT DOCUMENTS

CH 281195 A 2/1952
CN 1367885 A 9/2002
(Continued)

OTHER PUBLICATIONS

Office Action issued in Japanese Patent Application No. 2018-504499, dated Jul. 14, 2020.
(Continued)

*Primary Examiner* — Sean Kayes
(74) *Attorney, Agent, or Firm* — Knobbe, Martens, Olson & Bear, LLP

(57) ABSTRACT

A wristwatch (an example of a timepiece) includes a small dial (an example of a dial) and a rotary disk (an example of a rotary member). The small dial includes a sun mark for displaying the state of the sun. The rotary disk covers the small dial and rotates in a 24-hour period. The rotary disk includes the sun state indicator that changes the visibility of the sun mark in accordance with the rotational position of the rotary disk. One of the small dial and the rotary member includes a plurality of numbers (an example of indexes) for indicating time. The other of the small dial and the rotary member includes a time indicator that indicates a number in accordance with the rotational position of the rotary disk.
(Continued)

The time indicator and the sun state indicator are disposed relative to each other in a positional relationship such that the visibility of the sun mark by the sun state indicator corresponds to the state of the sun corresponding to the number indicated by the time indicator.

9 Claims, 13 Drawing Sheets

(51) Int. Cl.
*G04B 19/06* (2006.01)
*G04B 19/04* (2006.01)
*G04B 19/20* (2006.01)
*G04B 19/247* (2006.01)

(52) U.S. Cl.
CPC ..... *G04B 19/085* (2013.01); *G04B 19/202* (2013.01); *G04B 19/247* (2013.01); *G04B 19/26* (2013.01)

(58) Field of Classification Search
USPC ..... 368/16, 17
See application file for complete search history.

(56) References Cited

U.S. PATENT DOCUMENTS

| | | | | |
|---|---|---|---|---|
| 4,684,260 | A * | 8/1987 | Jackie | G04B 19/268 368/16 |
| 4,759,002 | A | 7/1988 | Cash | |
| 4,766,579 | A * | 8/1988 | Sporring | G04B 19/25 368/15 |
| 5,023,849 | A * | 6/1991 | Vaucher | G04B 19/26 368/15 |
| 6,359,839 | B1 * | 3/2002 | Schenk | G04B 19/26 368/16 |
| 6,683,821 | B1 * | 1/2004 | Emtyazi | G04B 19/046 368/233 |
| 6,901,032 | B1 | 5/2005 | Eo et al. | |
| 2004/0081027 | A1 | 4/2004 | Gilomen | |
| 2013/0070574 | A1 | 3/2013 | Takasawa | |
| 2014/0086019 | A1 * | 3/2014 | Le Doussal | G04B 19/262 368/17 |
| 2014/0247699 | A1 | 9/2014 | Sembritzki et al. | |

FOREIGN PATENT DOCUMENTS

| | | | |
|---|---|---|---|
| CN | 102998963 | A | 3/2013 |
| CN | 203894543 | U | 10/2014 |
| DE | 29710570 | U1 | 10/1997 |
| EP | 2570872 | A2 | 3/2013 |
| EP | 2602673 | A1 | 6/2013 |
| JP | S60-31082 | A | 2/1985 |
| JP | S60-189881 | U | 12/1985 |
| JP | H02-122383 | U | 10/1990 |
| JP | 2004-144754 | A | 5/2004 |
| JP | 2013-054022 | A | 3/2013 |
| JP | 2013-061311 | A | 4/2013 |

OTHER PUBLICATIONS

Chinese Office Action; CN Application No. 201780012829.5; dated Sep. 23, 2019; 7 pages.
Extended EP Search Report; Application No. 17763227.0; dated Sep. 24, 2019; 5 pages.

* cited by examiner

TIMEPIECE

CROSS-REFERENCE TO RELATED APPLICATION

The present application is a national stage application under 35 U.S.C. § 371(c) of PCT Application No. PCT/JP2017/008954, filed on Mar. 7, 2017, which claims priority to Japanese Patent Application No. 2016-045722, filed on Mar. 9, 2016, the disclosure of which is hereby incorporated by reference in its entirety.

TECHNICAL FIELD

This invention relates to a timepiece and more specifically to a timepiece that displays the state or position of the sun in 24 hours.

BACKGROUND ART

A timepiece displays time by pointing out numbers mainly with pointers or hands. In addition to the function of pointing out the numbers, some timepieces intuitively (directly) display the state or position of the sun from the sunrise to the sunset. For example, such a timepiece displaying the state of the sun may include a window member having a window, and a rotating disk disposed behind the window member. The rotating disk may include a nighttime image (the crescent moon on a shadow background) in a half of an angular region of the disk and a daytime image (the sun on a shadow-less background) in the other half of the angular region of the disk. The daytime image and the nighttime image are alternately displayed through the window of the window member when the disk rotates in a 24-hour period so that the timepiece intuitively (directly) displays the state of the sun (See, Patent Literature 1: U.S. Pat. No. 4,759,002 B, for example).

The window member includes numbers arranged in the circumferential direction which corresponds to time from the sunrise to the sunset. A boundary line between the daytime image and the nighttime image indicates or points out one of the numbers to indicate the current time.

SUMMARY

However, the timepiece disclosed in the Patent Literature 1 requires a single-purpose movement dedicated to alternately expose the daytime image and the nighttime image and accordingly display the state or position of the sun. Such a timepiece has low versatility and accordingly increases manufacturing cost.

The present disclosure is made in view of the above issues. An object of the present disclosure is to provide a timepiece that can intuitively and directly display the state or position of the sun not by the single-purpose or dedicated movement but by a general-purpose movement.

A timepiece of the present disclosure includes a dial including a sun mark for displaying a state of the sun, and a rotary member that covers the dial and rotates in a 24-hour period. The rotary member includes a sun state indicator that changes the visibility of the sun mark in accordance with the rotational position of the rotary member. One of the dial and the rotary member includes a plurality of indexes for indicating time. The other of the dial and the rotary member includes a time indicator that indicates the indexes in accordance with the rotational position of the rotary member. The time indicator and the sun state indicator are disposed relative to each other in a positional relationship such that the visibility of the sun mark by the sun state indicator corresponds to the state or position of the sun at time corresponding to one of the indexes indicated by the time indicator.

DETAILED DESCRIPTION

Hereinafter, embodiments of a timepiece according to the present disclosure will be described with reference to accompanying drawings.

Figure 1:
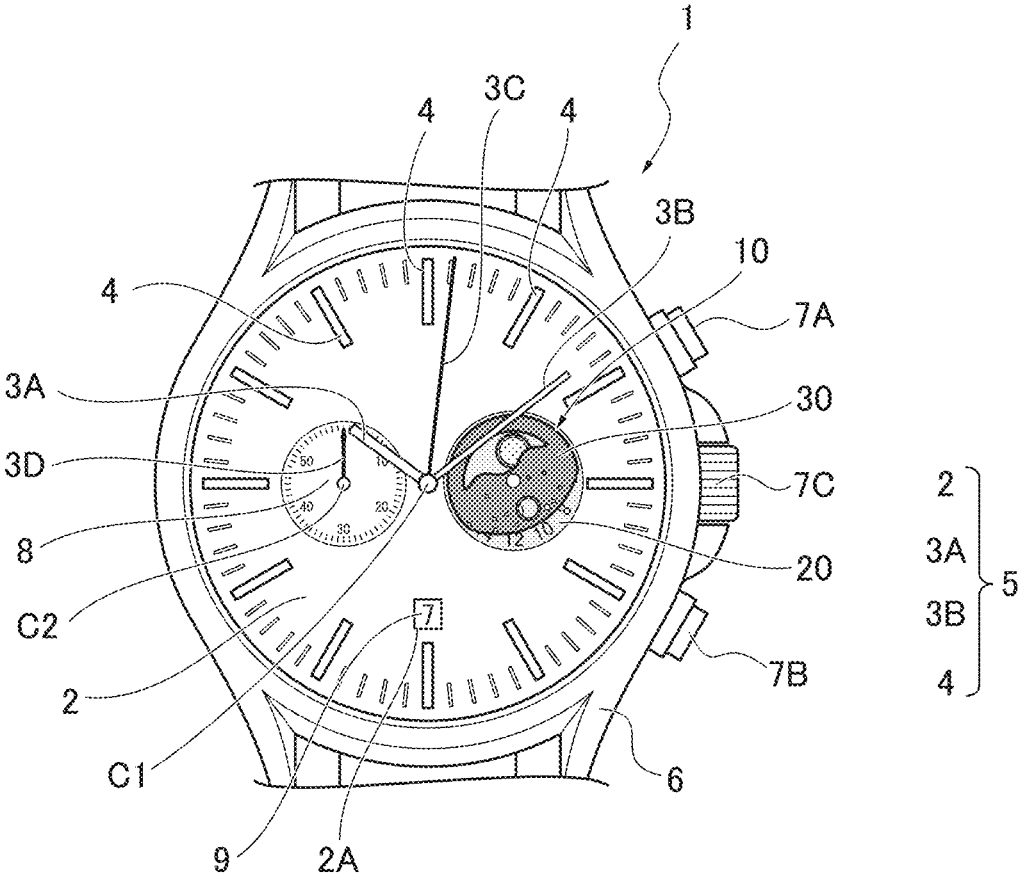
FIG. 1 is a plan view illustrating a wrist watch according to an embodiment of a timepiece in the present disclosure.
Figure 2:
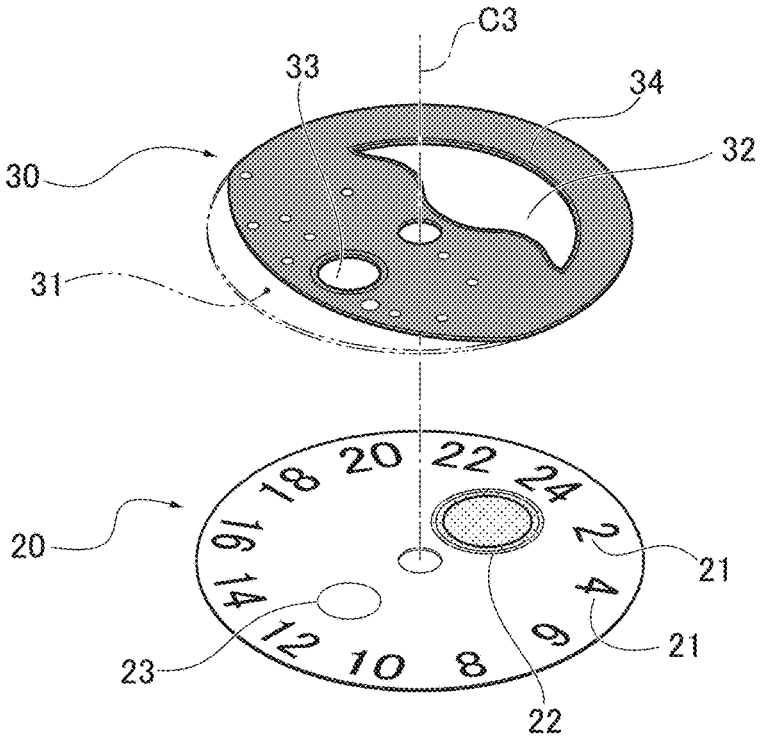
FIG. 2 is an exploded perspective view illustrating a sun state display disposed at a three o'clock position in FIG. 1.
Figure 3:
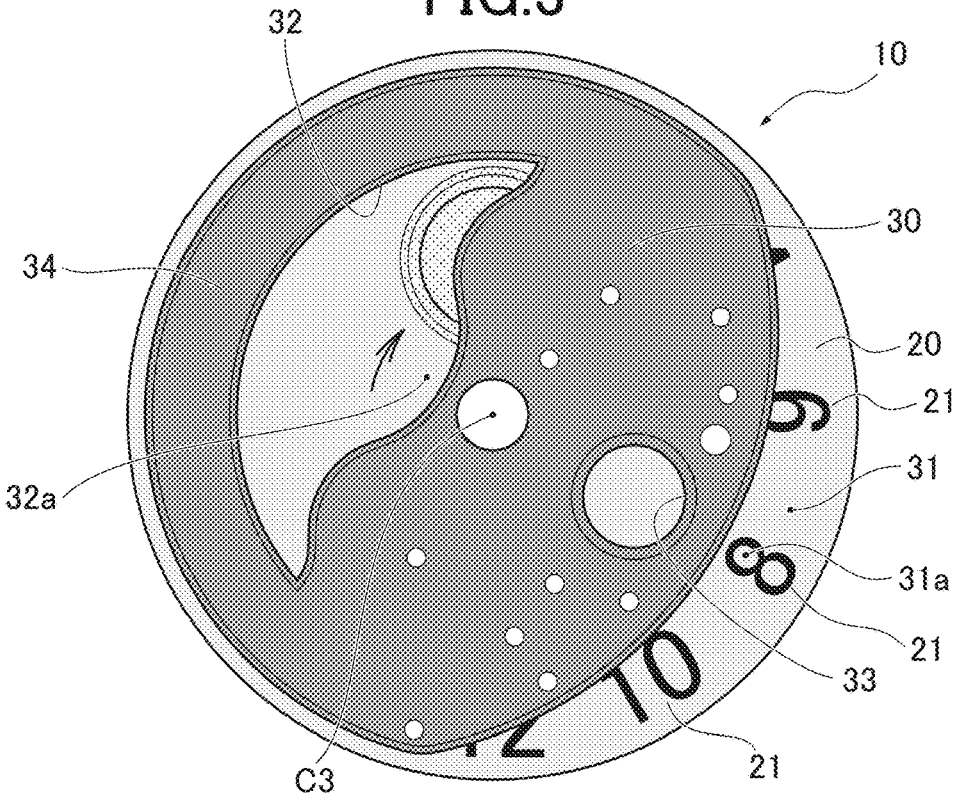
FIG. 3 is an enlarged view illustrating the sun state display in FIG. 1.

(Overall Configuration of Timepiece) FIG. 1 is a plan view illustrating a wrist watch 1 according to an embodiment of a timepiece in the present disclosure. FIG. 2 is an exploded perspective view illustrating the configuration of a sun state display 10 which is provided in a three o'clock position shown in FIG. 1. FIG. 3 is an enlarged view illustrating the sun state display 10.

The wrist watch 1 shown in the drawings includes a dial 2, an hour hand 3A and a minute hand 3B which rotate about a center C1 (the center of the watch) of the dial 2, twelve bar indexes 4 disposed in the outer circumferential portion of the dial 2, and a time display 5.

The time display 5 indicates time in a 12-hour format by the hour hand 3A and the minute hand 3B which point out the bar indexes 4. The hour hand 3A rotates once in twelve hours and the minute hand 3B rotates once in sixty minutes.

A chronograph second hand 3C is provided coaxially with the hour hand 3A and the minute hand 3B. The chronograph second hand 3C is moved by means of two push buttons 7A, 7B provided in a casing 6 of the wrist watch 1. A chronograph dial 8 is provided in a position eccentric from the center C1 of the dial 2 in a nine o'clock direction. The chronograph dial 8 is a dial for sixty minutes which is pointed out by a chronograph minute hand 3D. The chronograph minute hand 3D rotates about a center C2 once in sixty minutes. Note that the chronograph dial 8 is formed as a part of the dial 2 in the time display 5.

A date window 2A is provided in a six o'clock position in the dial 2. The date window 2A is an opening for displaying a date. A date disk is disposed behind the dial 2. The date disk includes numbers corresponding to dates, and constitutes a date display 9 which displays a date by exposing one of the numbers in the date disk through the date window 2A. The hour hand 3A and the minute hand 3B of the time display 5 as well as the date disk of the date display 9 are moved by the movement of the wrist watch 1 but can be manually adjusted by means of a crown 7C provided in the casing 6.

(Configuration of Sun State Display) A sun state display 10 is provided in a position eccentric from the center C1 of the dial 2 toward a three o'clock direction. The sun state display 10 indicates time in the 24-hour format and displays the state or position of the sun corresponding to the time in the 24-hour format. The state of the sun displayed by the sun state display 10 intuitively (directly) indicates the state (appearance) or position of the sun from the sunrise to the sunset (sundown).

Note that the state or position of the sun displayed by the sun state display 10 does not precisely reflect the time of the sunrise and the time of the sunset in each day in countries or areas where the wrist watch 1 is used. The state of the sun simply indicates whether it is the daytime where the sun has risen or the nighttime where the sun has gone down. The state of the sun is uniformly fixed to time displayed in the 24-hour format.

As shown in FIG. 2, the sun state display 10 includes the circular small dial 20 (an example of a dial) and a rotary disk 30 (an example of a rotary member) which covers the small dial 20. The rotary disk 30 has a substantially circular shape which is partially cut out. The small dial 20 is configured as a part of the dial 2 of the time display 5. The small dial 20 includes twelve numbers 21 (i.e. 2, 4, . . . , 22, 24) as an example of indexes for indicating time in the 24-hour format. The twelve numbers 21 are arranged in the clockwise direction (right-handed rotation) about a center C3 along the circumference of the small dial 20. The number 21 corresponding to 24:00 is located in the highest position in the small dial 20, while the number 21 corresponding to twelve o'clock (12:00) is located in the lowest position in the small dial 20.

The small dial 20 includes a sun mark 22 for displaying the position or state of the sun and a moon mark 23 which represents the moon. The sun mark 22 and the moon mark 23 have different shapes (sizes, the shapes of outlines or the like) and different colors so as to be visually distinguished from each other. Specifically, the sun mark 22 is larger than the moon mark 23 and is colored in yellow, for example. On the other hand, the moon mark 23 is smaller than the sun mark 22 and is colored in white, for example.

In this embodiment, the sun mark 22 and the moon mark 23 are placed in areas close to the center C3 of the small dial 20, and the numbers 21 are placed radially outward from the sun mark 22 and the moon mark 23. The sun mark 22 is disposed in a position opposite to the number 21 corresponding to twelve o'clock across the center C3 (i.e. in the position radially inward of the number 21 corresponding to 24:00). The moon mark 23 is disposed in a position opposite to the sun mark 22 across the center C3. In other word, the moon mark 23 is disposed in the position opposite to the number 21 corresponding to 24:00 (i.e. in the position radially inward of the number 21 corresponding to twelve o'clock).

An index shaft (not shown) is provided along the center C3 to extend through the small dial 20 and the rotary disk 30 is attached to the index shaft. The rotary disk 30 is disposed over the small dial 20 to rotate about the center C3 in the clockwise direction in a 24-hour period. The rotary disk 30 is made of an opaque metallic material. As shown in FIG. 2, the rotary disk 30 has a substantially circular shape which is partially cut out in a crescent shape. A cutout 31 in the crescent shape is an example of a time indicator which indicates or displays one of the numbers 21 of the small dial 20 corresponding to time in accordance with the rotational position of the rotary disk 30. The cutout 31 includes a center portion 31*a* in the rotational direction thereof. The center portion 31*a* entirely exposes one of the numbers 21 while portions of the cutout 31 other than the center portion 31*a* do not entirely expose the number 21. Accordingly, the cutout 31 functions as the time indicator since it indicates the current time by entirely exposing one of the numbers 21 corresponding to the current time.

The rotary disk 30 includes two openings 32, 33 extending through the rotary disk 30. The opening 32 is an example of a display window and has a substantially semicircular shape. The opening 32 is disposed in an area opposite to the cutout 31 across the center C3 to overlap the sun mark 22 by rotation. The opening 32 is also an example of a sun state indicator which changes the visibility of the sun mark 22 in accordance with the rotational position of the rotary disk 30. The opening 32 changes the exposure state or amount of the sun mark 22 in accordance with the rotational position of the rotary disk 30 and accordingly changes the visibility of the sun mark 22 so that the exposure state or amount of the sun mark 22 represents the state or position of the sun. The cutout 31 and the opening 32 are disposed relative to each other with a positional relationship such that the visibility of the sun mark 22 through the opening 32 corresponds to the state or position of the sun at the time corresponding to the number 21 displayed through the cutout 31.

The opening 32 includes a center portion 32*a* in the rotational direction. The center portion 32*a* is located opposite to the center portion 31*a* of the cutout 31 across the center C3. The center portion 32*a* of the opening 32 has a size to entirely expose the sun mark 22. Each end of the opening 32 in the rotational direction is formed with a curved line to have a recessed portion so that the sun mark 22 is exposed in a crescent shape. Note that each end of the opening 32 may be formed with a straight line instead of the curved line.

A masking portion 34 is provided in the radially outward position from the opening 32 of the rotary disk 30. The masking portion 34 is an arc band and configured to mask the numbers 21 in the outer circumference of the small dial 20 so that these numbers 21 cannot be seen. Accordingly, the band of the masking portion 34 has a width same as the height of the number 21 or wider than the height of the number 21. The surface of the rotary disk 30 includes a background in navy blue which represents an image of the night sky, and shining stars in white on the background.

The opening 33 is circular and has an area smaller than that of the opening 32 but larger than that of the moon mark 23. The opening 33 is disposed in an area opposite to the center portion 32*a* of the opening 32 across the center C3 and overlapping the moon mark 23 by the rotation. The opening 33 is an example of a moon indicator which changes the visibility of the moon mark 23 in accordance with the rotational position of the rotary disk 30. Accordingly, the opening 33 exposes the moon mark 23 when the opening 32 exposes the sun mark 22 at the center portion 32*a* in accordance with the rotation of the rotary disk 30.

Figure 4A:
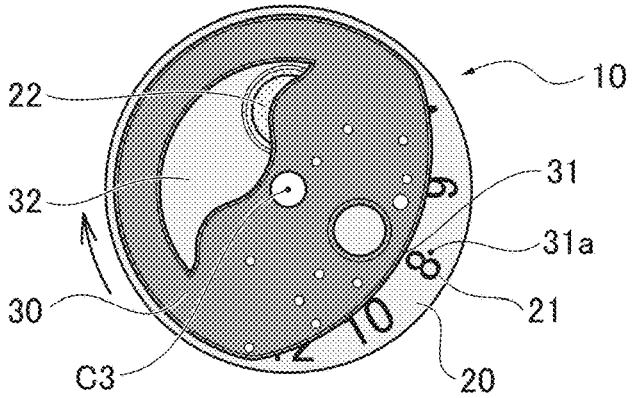
FIG. 4A is a view illustrating a display example of time around the sunrise in the 24-hour format and the state of the sun corresponding to the time displayed by the sun state display.
Figure 4B:
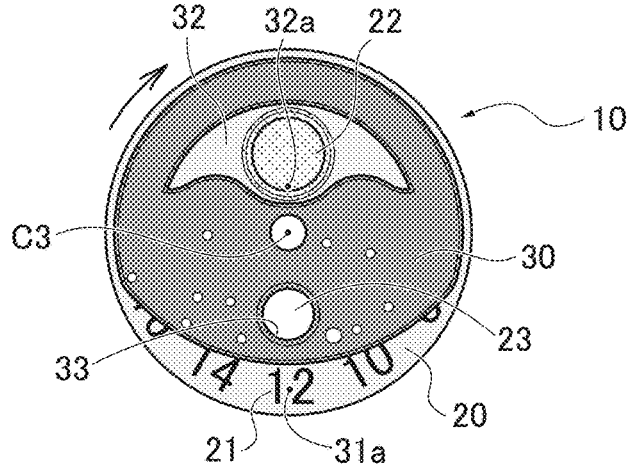
FIG. 4B is a view illustrating a display example of time around noon (12:00) in the 24-hour format and the state of the sun corresponding to the time displayed by the sun state display.
Figure 4C:
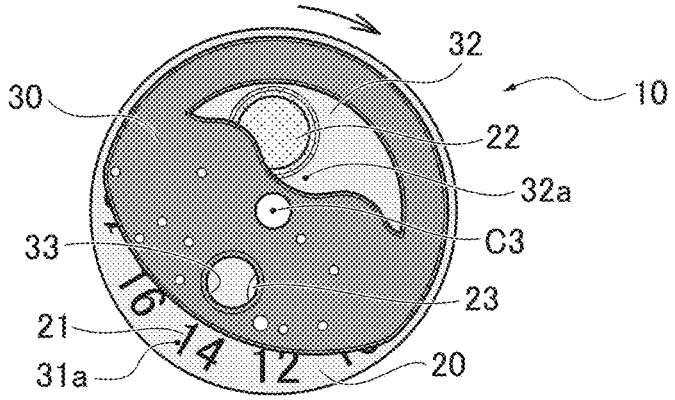
FIG. 4C is a view illustrating a display example of time around the sunset in the 24-hour format and the state of the sun corresponding to the time displayed by the sun state display.
Figure 4D:
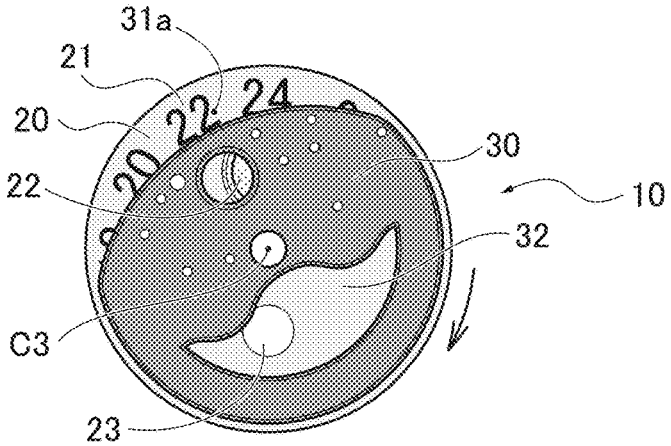
FIG. 4D is a view illustrating a display example of time at night in the 24-hour format and the state of the sun corresponding to the time displayed by the sun state display.

(Operation of Sun State Display) FIGS. 4A, 4B, 4C and 4D are views each illustrating time in the 24-hour format displayed by the sun state display 10 and the state of the sun corresponding to the time. FIG. 4A is a display example around the time of the sunrise. FIG. 4B is a display example around noon (12:00). FIG. 4C is a display example illustrating a state approaching the time of the sunset. FIG. 4D is a display example at night.

The rotary disk 30 of the sun state display 10 is rotated by the movement in conjunction with the time indicated by the hour hand 3A and the minute hand 3B of the time display 5. The number 21 in the small dial 20 exposed in the center portion 31*a* of the cutout 31 in the rotary disk 30 corresponds to "hour" pointed out by the hour hand 3A.

Accordingly, in the state shown in FIG. 4A, the sun state display 10 exposes "8" of the numbers 21 in the center portion 31*a* of the cutout 31 and accordingly indicates the time around 8 a.m. At this time, the opening 32 exposes a small portion of the sun mark 22. Accordingly, this exposure state of the sun mark 22 in the sun state display 10 indicates the sunrise.

Now, in the state shown in FIG. 4B, the sun state display 10 exposes "12" of the numbers 21 in the center portion 31*a* of the cutout 31 and accordingly indicates the time around noon (12:00). At this time, the opening 32 entirely exposes the sun mark 22 in the center portion 32*a*. Accordingly, this exposure state of the sun mark 22 in the sun state display 10 indicates the daytime. Note that the opening 33 exposes the moon mark 23 at this time.

In the state shown in FIG. 4C, the sun state display 10 exposes "14" of the numbers 21 in the center portion 31*a* of the cutout 31 and accordingly indicates the time around 14:00 (2 p.m.). At this time, the opening 32 exposes most of the sun mark 22. However, the sun mark 22 moves away from the opening 32 and the rotary disk 30 covers a part of the sun mark 22. Accordingly, this exposure state of the sun mark 22 in the sun state display 10 indicates the state approaching the sunset.

Now in the state shown in FIG. 4D, the sun state display 10 exposes "22" of the numbers 21 in the center portion 31*a* of the cutout 31 and accordingly indicates the time around 22:00 (10 p.m.). At this time, the opening 32 does not expose the sun mark 22. The sun mark 22 is covered by the rotary disk 30 except an area where the opening 33 (the moon indicator) overlaps the sun mark 22. Accordingly, this exposure state of the sun mark 22 in the sun state display 10 indicates the night time. The opening 32 exposes the moon mark 23 to emphasize the image of the night.

As described above, according to the wrist watch 1 in this embodiment, the sun mark 22 in the sun state display 10 can intuitively and directly display the state or position of the sun. Further, in the existing wrist watch including the 24-hour time display for indicating time in the 24-hour format, the sun state display 10 can be configured by providing the rotary disk 30 replaced with pointers or needles rotating about the center C3, and by adding the sun mark 22 to the existing small dial of the 24-hour time display (including twelve numbers 21 (i.e. 2, 4, . . . , 22, 24) as the indexes each indicating time in the 24-hour format). Accordingly, it is not necessary to dispose a single-purpose or dedicated movement but the existing general-purpose movement can be used as the movement of the sun state display 10.

Especially, the wrist watch 1 includes the time display 5 which indicates time in the 12-hour format by the hour hand 3A and the minute hand 3B rotating about the center C1 of the dial 2 and accordingly elements for driving the time display 5 such as gear trains, a motor and the like are already provided inside the movement. Accordingly, providing a mechanism dedicated to drive the sun state display 10 in addition to the mechanism for driving the time display 5 complicates the structure of the wrist watch 1. The wrist watch 1 already includes the movement for the timepiece including the time display 5 and the 24-hour time display in a position eccentric from the center C1 of the time display 5. Therefore, in the wrist watch 1 according to this embodiment, such a movement can be used as it is so that it is possible to suppress the manufacturing cost for the wrist watch 1.

Further, the wrist watch 1 includes, as the sun state indicator formed in the rotary disk 30, the opening 32 (display window) which changes the visibility by changing the exposure state or amount of the sun mark 22 in accordance with the rotational position of the rotary disk 30. As a result, the state or position of the sun can be displayed by the exposure state of the sun mark 22 and accordingly a user can recognize intuitively (directly) and visually the state or position of the sun.

Similarly, the wrist watch 1 includes, as the time indicator formed in the rotary disk 30, the cutout 31 which sequentially exposes the number 21 by rotation in accordance with the rotational position of the rotary disk 30. Accordingly, the time corresponding to the number 21 can be indicated so that a user can easily and visually recognize the time. In the 24-hour time display where the needles or pointers indicate the numbers 21, a user sees all numbers 21 in the small dial 20 but it is harder to see the needles or pointers smaller and thinner than the hour hand 3A and the minute hand 3B in the time display 5.

On the other hand, the wrist watch 1 exposes only one number 21 corresponding to the current time but does not disclose other numbers 21. Therefore, a user can instantly see only the exposed one of the numbers 21 and accordingly recognize the time instantly. In the wrist watch 1, the cutout 31 exposes one number 21 corresponding to the current time and adjacent two numbers 21. However, the cutout 31 substantially exposes only the number 21 corresponding to the current time since the other two numbers 21 are not completely exposed but partially hidden.

The numbers 21 in the small dial 20 are arranged radially outward of the sun mark 22 in the circumferential direction of the small dial 20. Accordingly, each of the numbers 21 can be larger than those arranged radially inward of the sun mark 22 so that the visibility of the numbers 21 can be improved.

Further, in the wrist watch 1, the weight balance with respect to the center C3 can be equalized so as to reduce the load on the shaft stem supporting the rotating plate 30 at the center C3 compared to the 24-hour time display including existing needles or pointers, which is replaced by the rotary disk 30 of the sun state display 10. Especially, the rotary disk 30 which is perfect circular includes the larger opening 32 in one of opposing two areas across the center C3 and the relatively larger cutout 31 and the relatively smaller opening 33 in the other of the two areas so that the weight balance between the two areas across the center C3 can be equalized. Moreover, the sun mark 22 exposed through the opening 32 is separate from the number 21 corresponding to the time exposed through the cutout 31 in the sun state display 10. Accordingly, a use can clearly distinguish and recognize the state or position of the sun and the time in the 24-hour format when the user sees the sun state display 10.

In the wrist watch 1 in the above embodiment, the sun state display 10 also displays the moon mark 23. However, the timepiece of the present disclosure does not necessarily display the moon mark 23. Therefore, the small dial 20 may not include the moon mark 23 and the rotary disk 30 may not include the opening 33. In this case, from the viewpoint of equalizing the weight balance described above, it is preferable to make the cutout 31 a little larger since the rotary disk 30 does not include the opening 33. The display of the moon mark 23 in the embodiment is applied to variations described below. However, the moon mark 23 may not be necessarily provided even in the variations where the moon mark 23 is displayed but may be displayed if desired.

Further, in the wrist watch 1 according to the above embodiment, the sun mark 22 is circular and has a shape and a color representing the sun. However, the sun mark 22 is required only to indicate the position of the sun corresponding to the time indicated by the cutout 31 and may not necessarily have the shape and the color representing the sun.

Variations (First Variation) In the wrist watch 1 according to the above embodiment, the rotary disk 30 is made of an opaque metal material, and accordingly, the sun state indicator is formed as the opening 32 extending through the rotary disk 30 in the thickness direction thereof, and the time indicator is formed as the cutout 31 extending through the rotary disk 30 in the thickness direction thereof. However, it is unnecessary to form the opening 32 and/or the cutout 31 in the case where the rotary disk 30 is made of a transparent resin material or a transparent glass material. Specifically, the sun state indicator corresponding to the opening 32 and the time indicator corresponding to the cutout 31 are transparent and other portions are colored opaque or translucent so that the transparent portions can indicate the state or position of the sun as the sun state indicator and indicate time as the time indicator.

Note that the opening and the cutout extending through the rotary disk 30 in the thickness direction as well as the transparent portions which do not extend through the rotary disk 30 in the thickness direction are examples of the display windows which expose portions disposed behind the rotary disk 30. In the above embodiment, the above variation and variations described below, the transparent portions which do not extend through the rotary disk or the small dial may be referred as the display window. Further, in a member overlapping the rotary disk or the small dial, either on the rear side or the upper side thereof, such that letters, marks and the like in the rotary disk or the small dial are not visually recognized, a part of the member configured such that the letters and the like can be visually recognized may also be referred as the display window (opening, cutout, or the like).

The display window which changes the exposure state or amount of the sun mark 22 is an example of the sun state indicator, and the display window which indicates indexes representing time is an example of the time indicator.

Figure 5A:
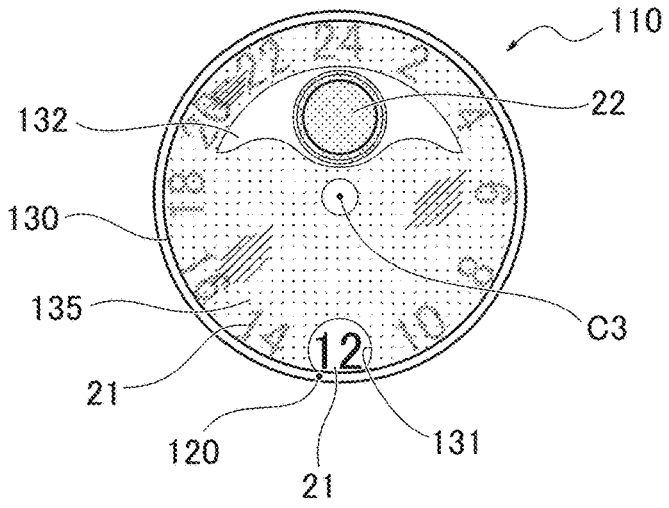
FIG. 5A is a plan view corresponding to FIG. 3 and illustrating a sun state display including a rotary disk made of a transparent material and a small dial.
Figure 5B:
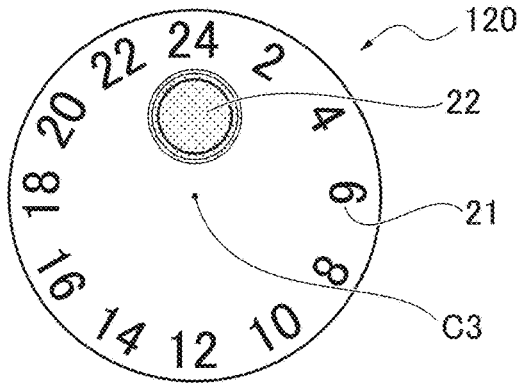
FIG. 5B is a plan view illustrating the small dial in the sun state display shown in FIG. 5A.
Figure 5C:
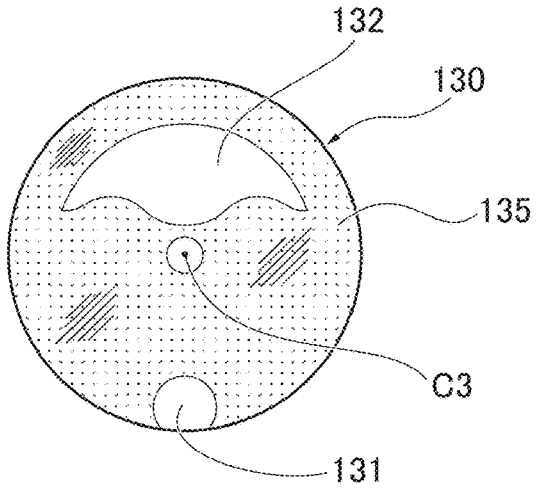
FIG. 5C is a plan view illustrating the rotary disk in the sun state display shown in FIG. 5A.

FIG. 5A is a plan view corresponding to FIG. 3 and illustrating a sun state display 110 including a rotary disk 130 made of a transparent material, and a small dial 120. FIG. 5B is a plan view illustrating the small dial 120 in the sun state display 110 shown in FIG. 5A. FIG. 5C is a plan view illustrating the rotary disk 130 in the sun state display 110 shown in FIG. 5A. The sun state display 110 shown in FIG. 5A is replaced from the sun state display 10 in the wrist watch 1 shown in FIG. 1. The wrist watch 1 including the sun state display 110 is also one embodiment of the timepiece according to the present disclosure.

As shown in FIG. 5B, the configuration of the small dial 120 in the sun state display 110 is the same as that of the small dial 20 with the exception that the small dial 20 does not include the moon mark 23. Specifically, the small dial 120 includes the twelve numbers 21 (i.e. 2, 4, . . . , 22, 24) for indicating time in the 24-hour format and the sun mark 22. The numbers 21 are disposed radially outward of the small dial 120. The sun mark 22 is disposed radially inward from the numbers 21.

As shown in FIG. 5C, the rotary disk 130 of the sun state display 110 is circular. In the rotary disk 130, a portion corresponding to the opening 32 in the rotary disk 30 is formed as a transparent display window 132 (an example of the display window) which does not extend through the rotary disk 130. The display window 132 is formed as the sun state indicator which exposes the sun mark 22 therethrough. Similarly, in the rotary disk 130, a portion corresponding to the cutout 31 in the rotary disk 30 is formed as a transparent circular window 131 (an example of the display window) which does not extend through the rotary disk 130. The circular window 131 is formed as the time indicator which exposes the numbers 21 corresponding to time therethrough.

Only one of the numbers 21 is entirely exposed through the circular window 131. Note that two numbers 21 may be partially exposed through the circular window 131 depending on the rotational position of the rotary disk 30.

In the rotary disk 130, a portion 135 excluding the display window 132 and the circular window 131 is colored in translucent blue. Therefore, the numbers 21 and the sun mark 22 in the small dial 120 behind the rotary disk 130 can be seen slightly through the colored portion 135 even when the numbers 21 and the sun mark 22 are not exposed through the circular window 131 and the display window 132. The portion 135 may be colored opaque to completely mask the numbers 21 and the sun mark 22 when the numbers 21 and the sun mark 22 are not exposed through the circular window 131 and the display window 132.

Moreover, the display window 132 and/or the circular window 131 may be colored in a light permeable (translucent) color with higher transmissivity than that of the portion 135. In this case, each of the display window 132 and the circular window 131 has higher visibility to the sun mark 22 and the numbers 21 than the portion 135 so that the sun mark 22 and the numbers 21 can be recognized within the display window 132 and the circular window 131. In this way, the visibility of the sun mark 22 and/or the numbers 21 may be changed by the display window 132 and the circular window 131 having higher visibility and the portion 135 having lower visibility.

According to the wrist watch 1 including the sun state display 110 configured as above, effects similar to the wrist watch 1 including the sun state display 10 can be achieved. Note that a transparent window may be provided which has a shape corresponding to the cutout 31 in the rotary disk 30 of the sun state display 10 instead of the circular window 131.

Figure 6:
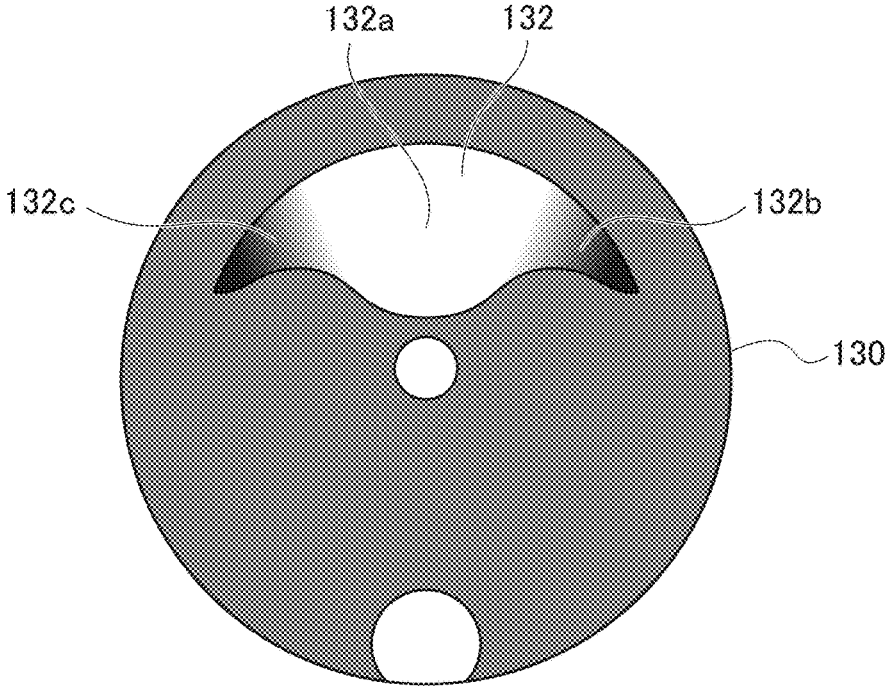
FIG. 6 is a view illustrating a display window of the rotary disk shown in FIG. 5C which includes graduations in portions close to both ends of the display window in a rotational direction.

(Second Variation) In the rotary disk 130 shown in FIG. 5C, the sun state indicator is not an opening but the display window 132 which does not extend through the rotary disk 130. Accordingly, the display window 132 may be partially colored. FIG. 6 shows the display window 132 including a gradation at each end portion 132*b*, 132*c* which is close to each end of the display window 132 in the rotational direction thereof. The gradation is added to the display window 132 of the rotary disk 130 shown in FIG. 5C. The end portion 132*b* close to one end of the display window 132 has a gradation with lower transparency than that of the center portion 132*a* to represent the morning glow and the sunrise. Similarly, the end portion 132*c* close to the other end of the display window 132 has a gradation with lower transparency than that of the center portion 132*a* to represent the sunset glow and the sunset.

Figure 7:
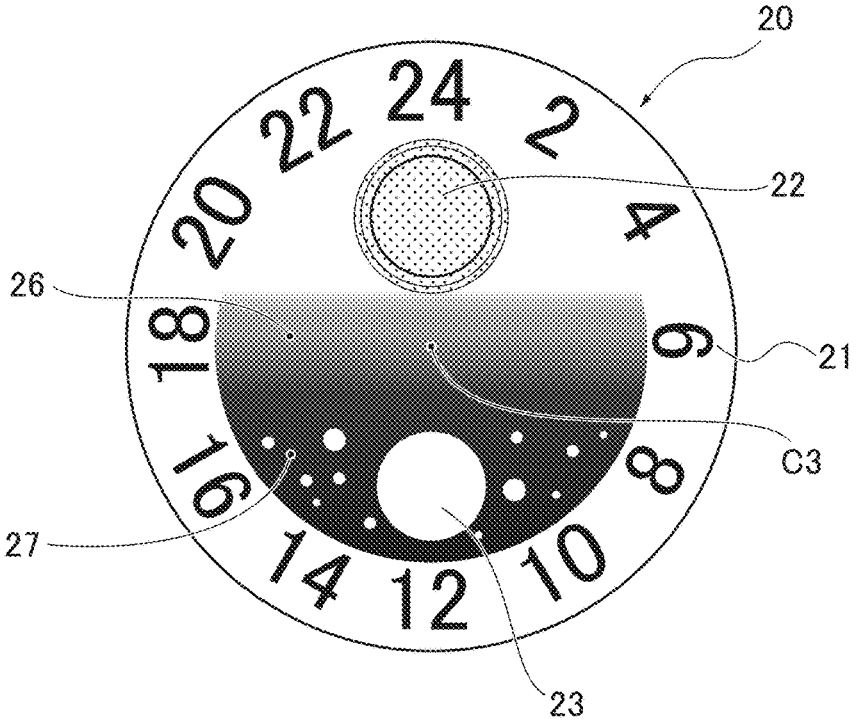
FIG. 7 is a view illustrating the small dial including numbers, a sun mark, a moon mark, a graduation representing the sunset glow and the morning glow, and a background representing the night sky with shinning stars around the moon mark.

(Third Variation) In the case where the rotary disk 30 includes the opening 32 such as the sun state display 10, the small dial 20 may includes a gradation and the like instead. In FIG. 7, the small dial 20 includes, in addition to the numbers 21, the sun mark 22 and the moon mark 23, a graduation 26 representing the sunset glow and the morning glow, and a background 27 representing the night sky with shinning stars around the moon mark 23. As shown in FIG. 7, a variety of expressions such as the morning glow, the sunset glow, the night sky and the like can be achieved even in the case where the rotary disk 30 includes the opening 32 since the small dial 20 includes the gradation 26 representing the sunset glow and the morning glow, and the background 27 presenting the night sky.

The small dial 20 shown in FIG. 7 may be combined with the rotary disk 130 shown in FIG. 5C to constitute the wrist watch 1 in which the gradation 26 and the background 27 in the small dial 20 can be seen through the display window 132.

Figure 8A:
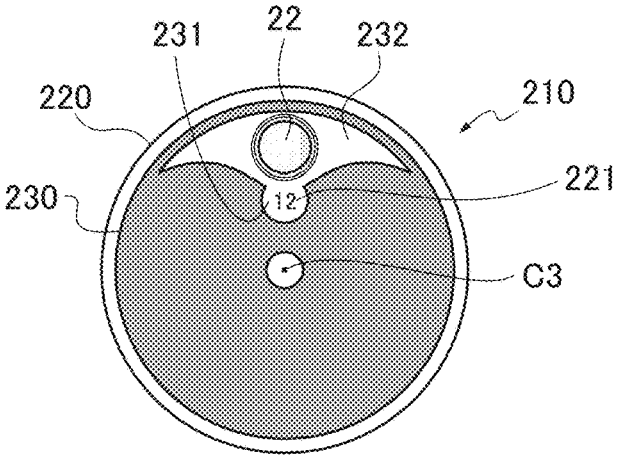
FIG. 8A is a plan view illustrating a sun state display replaced from the sun state display in the wrist watch shown in FIG. 1.
Figure 8B:
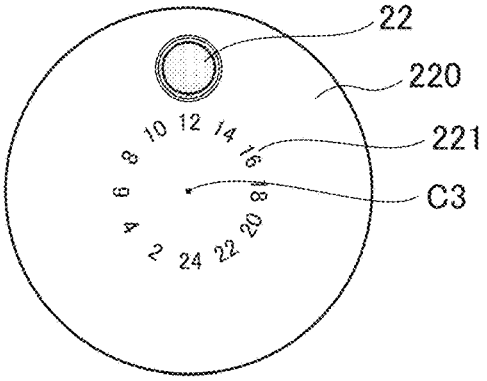
FIG. 8B is a plan view illustrating a small dial in the sun state display shown in FIG. 8A.
Figure 8C:
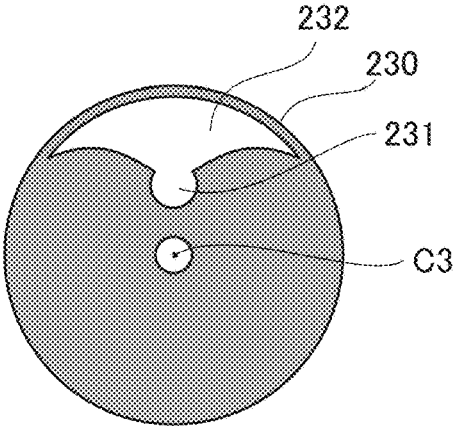
FIG. 8C is a plan view illustrating a rotary disk in the sun state display shown in FIG. 8A.

(Fourth Variation) In the wrist watch 1 in the embodiment or the variations described above, the numbers 21 are disposed radially outward of the sun mark 22 in the small dial 20. However, the numbers 21 may be disposed radially inward of the sun mark 22 in the dial of the timepiece according to the present disclosure. FIG. 8A is a plan view illustrating a sun state display 210 in the wrist watch 1 replaced from the sun state display 10. FIG. 8B is a plan view illustrating a small dial 220 in the sun state display 210 shown in FIG. 8A. FIG. 8C is a plan view illustrating a rotary disk 230 in the sun state display 210 shown in FIG. 8A.

The wrist watch 1 includes the sun state display 210 shown in FIG. 8A replaced from the sun state display 10 in the wrist watch 1 shown in FIG. 1. The wrist watch 1 including the sun state display 210 is also one embodiment of the timepiece according to the present disclosure. The sun state display 210 shown in FIG. 8A includes the small dial 220 replaced from the small dial 20, and the rotary disk 230 replaced from the rotary disk 30. As shown in FIG. 8B, the small dial 220 includes the sun mark 22 and twelve numbers 221 (i.e. 2, 4, . . . , 22, 24) radially inward of the sun mark 22. The numbers 21 are circumferentially arranged at equal intervals in the clockwise direction. The number 221 corresponding to twelve o'clock is provided in a position closest to the sun mark 22 and the number 221 corresponding to 24:00 is provided in a position furthest from the sun mark 22 across the center C3.

The rotary disk 230 is placed above the small dial 220 and rotates in the clockwise direction about the center C3 in the 24-hour period. The rotary disk 230 includes an opening 232 (may be a transparent display window which does not extend through the rotary disk 230. Hereinafter, the same applies to an opening and a cutout.) The opening 232 exposes the sun mark 22 in the small dial 220 corresponding to the daytime hours from the sunrise to the sunset similar to the opening 32 of the rotary disk 30. The rotary disk 230 also includes an opening 231 which is disposed radially inward of the opening 232 and exposes a number 221 corresponding to the current time.

According to the wrist watch 1 including the sun state display 210 configured above, the exposure state or amount of the sun mark 22 in the opening 232 can indicate the state of the sun at the time indicated in the 24-hour format by the number 221 exposed through the opening 231 as shown in FIG. 8A. According to this wrist watch 1, operations and effects similar to the wrist watch 1 of the embodiment described above can be achieved. In the sun state display 210, the opening 232 and the opening 231 are closely located relative to each other. Therefore, the state or position of the sun and the corresponding time can be seen closely.

Figure 9:
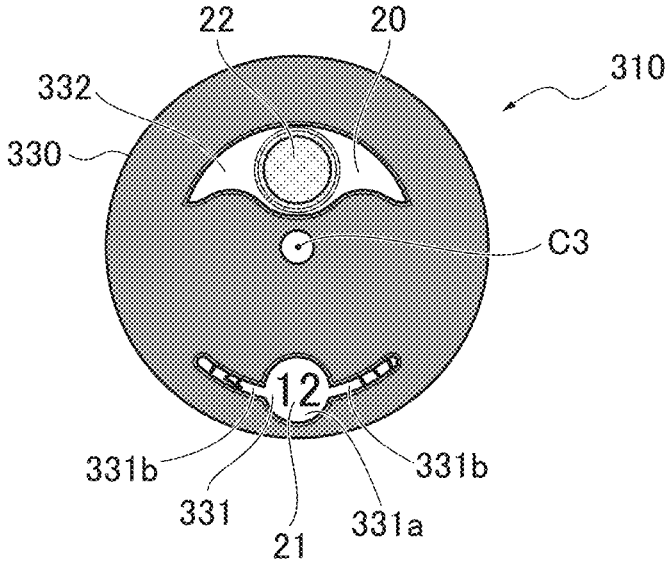
FIG. 9 is a view illustrating a (first) variation of a cutout of the rotary disk in the sun state display.
Figure 10:
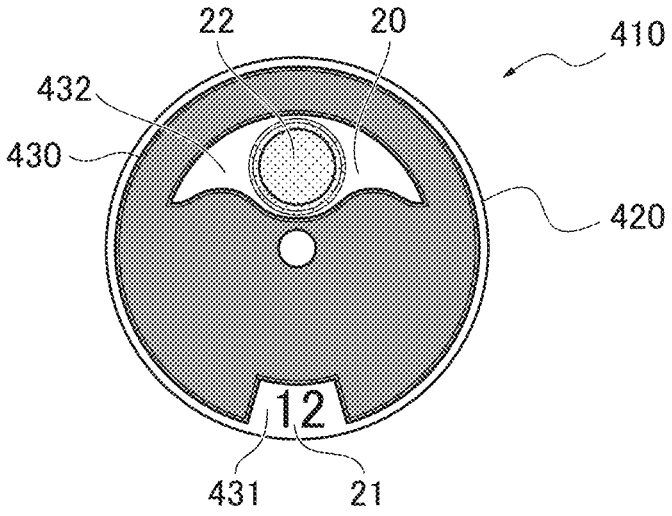
FIG. 10 is a view illustrating a (second) variation of a cutout of the rotary disk in the sun state display.

(Fifth Variation) FIGS. 9, 10 are views each illustrating a variation of the cutout 31 provided in the rotary disk 30 of the sun state display 10. The sun state display 310 shown in FIG. 9 includes a rotary disk 330 with an opening 331 replaced from the cutout 31 in the rotary disk 30. The opening 331 includes a circular window 331*a* and an elongate window 331*b*. The circular window 331*a* exposes one of the numbers 21 in the small dial 20. The elongate window 331*b* has an arc band shape and is connected to the circular window 331*a*. The elongate window 331*b* extends in the directions toward two numbers 21 adjacent the number 21 exposed through the circular window 331*a* to expose a part of the two numbers 21. The rotary disk 330 includes an opening 332 which exposes the sun mark 22 of the small dial 20. The circular window 331*a* may extend through the rotary disk 330 similar to the cutout 31. The circular window 331*a* may be formed as a transparent portion which does not extend through the rotary disk 330.

A sun state display 410 shown in FIG. 10 includes a rotary disk 430 provided with a rectangular cutout 431 instead of the cutout 31 in the rotary disk 30. The cutout 431 exposes one of the numbers 21 in the small dial 20. The rotary disk 430 includes an opening 432 which exposes the sun mark 22 of the small dial 20.

The wrist watch 1 including a sun state display 310 and the wrist watch 1 including the sun state display 410 replaced from the sun state display 10 in the wrist watch 1 shown in FIG. 1 are also embodiments of the timepiece according to the present disclosure. According to these wrist watches 1, operations and effects similar to the wrist watch 1 in the embodiment described above can be achieved.

Figure 11A:
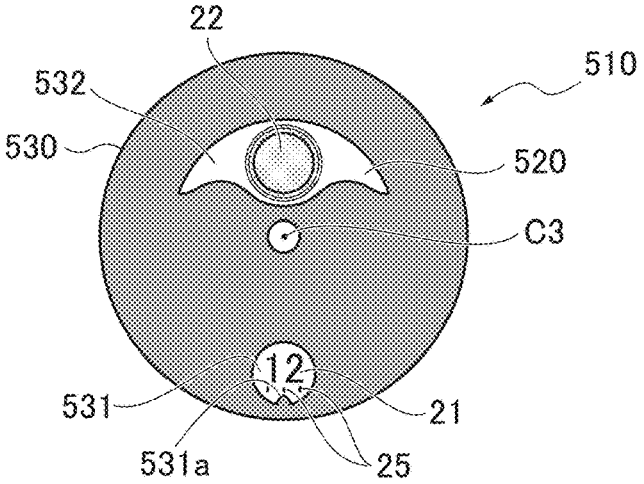
FIG. 11A is a plan view illustrating a sun state display replaced from the sun state display in the wrist watch shown in FIG. 1.
Figure 11B:
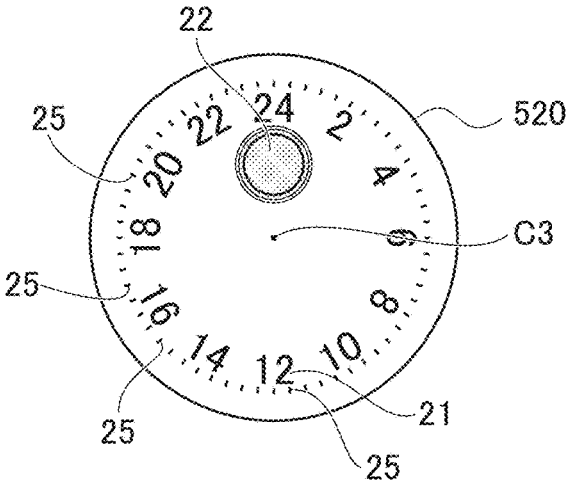
FIG. 11B is a plan view illustrating a small dial in the sun state display shown in FIG. 11A.
Figure 11C:
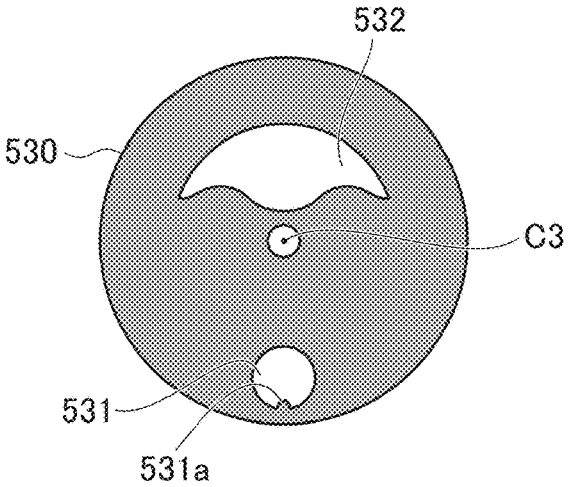
FIG. 11C is a plan view illustrating a rotary disk in the sun state display shown in FIG. 11A.

(Sixth Variation) FIG. 11A is a plan view illustrating a sun state display 510 of the wrist watch 1 replaced from the sun state display 10. FIG. 11B is a plan view illustrating a small dial 520 in the sun state display 510 shown in FIG. 11A. FIG. 11C is a plan view illustrating a rotary disk 530 in the sun state display 510 shown in FIG. 11A.

The wrist watch 1 includes the sun state display 510 shown in FIG. 11A replaced from the sun state display 10 in the wrist watch 1 as shown in FIG. 1. The wrist watch 1 including the sun state display 510 is also one embodiment of the timepiece according to the present disclosure. The sun state display 510 shown in FIG. 11A includes the small dial 520 replaced from the small dial 20, and the rotary disk 530 replaced from the rotary disk 30. As shown in FIG. 11B, the small dial 520 includes the sun mark 22 and the twelve numbers 21 (i.e. 2, 4, . . . , 22, 24 corresponding to time in the 24-hour format) provided radially outward of the sun mark 22. The numbers 21 are circumferentially arranged at equal intervals in the clockwise direction.

In addition, the small dial 520 includes scale marks 25 provided radially outward of the numbers 21. The scale marks 25 divide a space between adjacent two numbers 21 into five sections. The angle of the interval between the two scale marks 25 is six [degrees]. In relation to the rotary disk 530 rotating in the 24-hour period, the rotary disk 530 rotates by one scale mark 25 in twenty four [minutes].

The rotary disk 530 is placed over the small dial 520 and rotates about the center C3 in the clockwise direction in the 24-hour period. The rotary disk 530 includes a circular window 531 similar to the circular window 331*a* of the rotary disk 330 shown in FIG. 9. The circular window 531 exposes one of the numbers 21 in the small dial 520 which corresponds to time in the 24-hour format.

The circular window 531 includes a triangular protruding pointer 531*a* in the circumferential edge thereof. The tip of the protruding pointer 531*a* corresponds to the apex of the triangle and points out one of the scale marks 25 in the small dial 520. Accordingly, in the sun state display 510, the circular window 531 exposes the number 21 representing the time corresponding to the exposure state of the sun mark 22 (the position of the sun) in an opening 532. Further, the protruding pointer 531*a* of the circular window 531 points out the scale mark 25 so that the time can be more precisely indicated compared to the time indicated by the numbers 21.

Figure 12A:
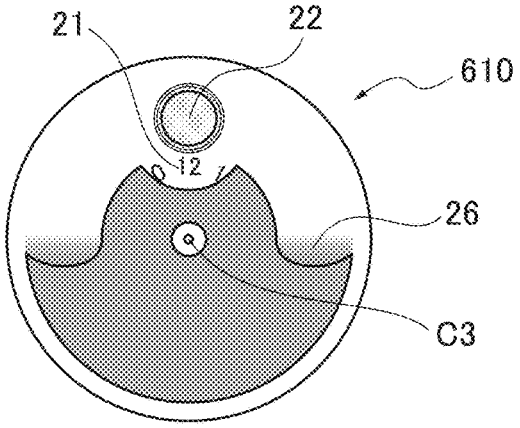
FIG. 12A is a plan view illustrating a sun state display replaced from the sun state display in the wrist watch shown in FIG. 1.
Figure 12B:
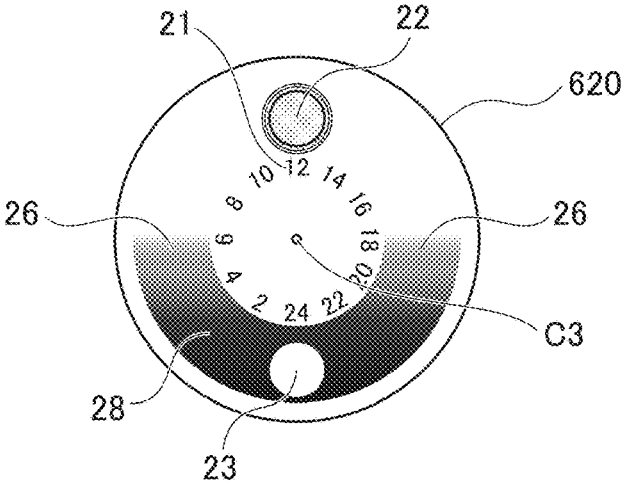
FIG. 12B is a plan view illustrating a small dial in the sun state display shown in FIG. 12A.
Figure 12C:
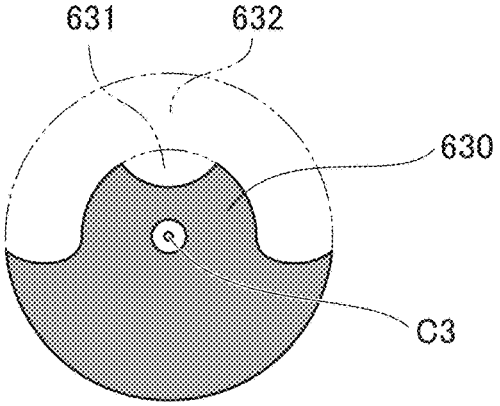
FIG. 12C is a plan view illustrating a rotary disk in the sun state display shown in FIG. 12A.

(Seventh Variation) FIG. 12A is a plan view illustrating a sun state display 610 in the wrist watch 1 replaced from the sun state display 10. FIG. 12B is a plan view illustrating a small dial 620 in the sun state display 610 shown in FIG. 12A. FIG. 12C is a plan view illustrating a rotary disk 630 in the sun state display 610 shown in FIG. 12A.

The wrist watch 1 including the sun state display 610 shown in FIG. 12A replaced from the sun state display 10 in the wrist watch 1 shown in FIG. 1 is also one embodiment of the timepiece according to the present disclosure. The sun state display 610 shown in FIG. 12A includes the small dial 620 (see FIG. 12B) replaced from the small dial 20, and the rotary disk 630 (see FIG. 12C) replaced from the rotary disk 30. As shown in FIG. 12B, the small dial 620 includes the sun mark 22 and twelve numbers 21 (i.e. 2, 4, . . . , 22, 24 corresponding to time in the 24-hour format) provided radially inward of the sun mark 22. The numbers 21 are circumferentially arranged at equal intervals in the clockwise direction.

Further, the small dial 620 includes the gradation 26 representing the sunset glow in an area corresponding to the numbers 21 from about 18 to about 19, and the gradation 26 representing the morning glow in an area corresponding to the numbers 21 from about 5 to about 6. The graduations 26 are provided on the same circumference as the sun mark 22. Further, the small dial 620 includes the background 28 in an area corresponding to the numbers 21 from 19 to about 5, and the moon mark 23 in a position of 24 of the numbers 21. The background 28 and the moon mark 23 are provided on the same circumference as the sun mark 22. The background 28 is colored in navy blue or black which represents the night sky.

The rotary disk 630 is disposed over the small dial 620 and rotates about the center C3 in the clockwise direction in the 24-hour period. The rotary disk 630 includes cutouts 631, 632. The cutout 632 is configured to change the visibility of the sun mark 22, the moon mark 23, the gradation 26 and the background 28. The cutout 631 is configured to expose one of the numbers 21 corresponding to the visibility of the sun mark 22 and the like.

The wrist watch 1 including the sun state display 610 replaced from the sun state display 10 in the wrist watch 1 shown in FIG. 1 can achieve operations and effects similar to the wrist watch 1 of the embodiment described above.

(Eighth Variation) In the embodiment and the variations described above, the dial includes the indexes corresponding to time, and the rotary disk includes the display window (the opening, the cutout, the transparent portion and the like) which is an example of the time indicator for indicating the indexes. However, the timepiece of the present disclosure is not limited to the above configurations. Specifically, in the timepiece of the present disclosure, the rotary disk may include indexes corresponding to time, and the dial may include the time indicator which indicates the indexes.

Figure 13A:
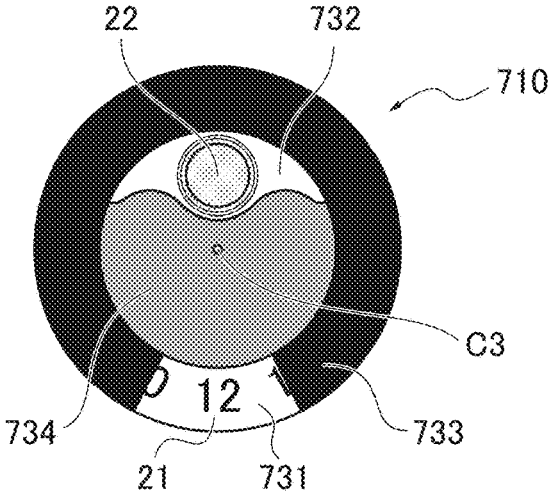
FIG. 13A is a plan view illustrating a sun state display replaced from the sun state display in the wrist watch shown in FIG. 1.
Figure 13B:
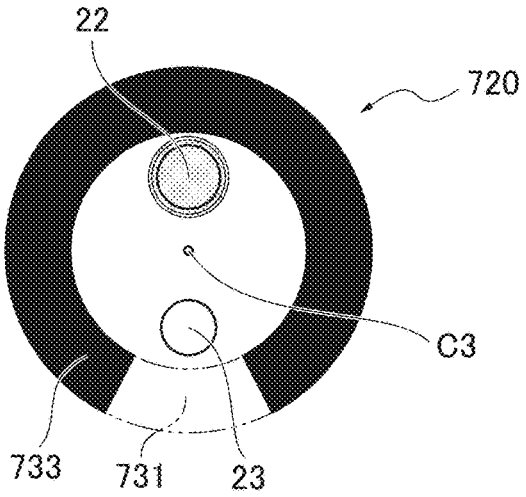
FIG. 13B is a plan view illustrating a small dial in the sun state display shown in FIG. 13A.
Figure 13C:
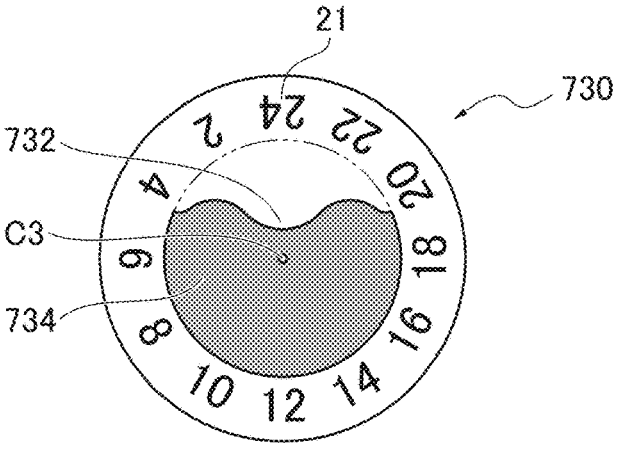
FIG. 13C is a plan view illustrating a rotary disk in the sun state display shown in FIG. 13A.

FIG. 13A is a plan view illustrating a sun state display 710 in the wrist watch 1 replaced from the sun state display 10. FIG. 13B is a plan view illustrating a small dial 720 in the sun state display 710 shown in FIG. 13A. FIG. 13C is a plan view illustrating a rotary disk 730 in the sun state display 710 shown in FIG. 13A.

The wrist watch 1 includes the sun state display 710 shown in FIG. 13A replaced from the sun state display 10 in the wrist watch 1 shown in FIG. 1. The wrist watch 1 including the sun state display 710 is also one embodiment of the timepiece according to the present disclosure. The sun state display 710 shown in FIG. 13A includes the small dial 720 replaced from the small dial 20, and the rotary disk 730 replaced from the rotary disk 30. The small dial 720 may be made of metal or resin. As shown in FIG. 13B, the small dial 720 includes the sun mark 22, the moon mark 23 opposite to the sun mark 22 across the center C3, and a colored masking band 733 radially outward of the sun mark 22. The masking band 733 is an arc band.

The rotary disk 730 is made of transparent resin, grass or the like. The rotary disk 730 is disposed over the small dial 720 and rotates about the center C3 in the clockwise direction in the 24-hour period. As shown in FIG. 13C, the rotary disk 730 includes the twelve numbers 21 (i.e. 2, 4, . . . , 22, 24 corresponding to time in the 24-hour format). The twelve numbers 21 are radially provided in an area overlapped by the masking band 733 of the small dial 720 when the small dial 720 overlaps the rotary disk 730 with the common center C3. The numbers 21 are arranged at equal intervals (an interval by 30 [degrees] of a rotation angle about the center C3) in the counterclockwise direction in the above order.

Further, the rotary disk 730 includes a background 734 radially inward of the numbers 21. The background 734 is circular and dark-colored. The background 734 is colored in a color such that the sun mark 22 cannot be visually recognized when the sun mark 22 overlaps the background 734. The background 734 may have the same color as the sun mark 22 or may have an opaque color. Accordingly, only the background 734 may be made of metal or by opaque printing.

The background 734 includes a display window 732 for the sun mark 22. The display window 732 exposes the sun mark 22 only in a predetermined rotation angle of the rotary disk 730 when the small dial 720 overlaps the rotary disk 730 with the common center C3. Specifically, the display window 732 is a circular portion including the background 734 and is uncolored and transparent so that the sun mark 22 can be exposed through the display window 732. Note that the display window 732 may be an opening extending through the rotary disk 730 in the thickness direction thereof.

The small dial 720 includes a display window 731 which discontinues the masking band 733. The display window 731 is provided in an arc area where the twelve numbers 21 in the rotary disk 730 are arranged in a predetermined rotation angle and the sun mark 22 is exposed through the display window 732 when the small dial 720 overlaps the rotary disk 730 with the common center C3. The masking band 733 is colored in a color such that the numbers 21 in the rotary disk 730 cannot be visually recognized when small dial 720 overlaps the numbers 21 while the display window 731 is colored in a color such that the numbers 21 can be visually recognized. It is preferable for such a color to emphasize the color of the numbers 21 but the color is not limited thereto. The display window 731 may be white in the case where the numbers 21 are black, for example.

According to the wrist watch 1 including the sun state display 710 configured as above, the state or position of the sun can be intuitively and directly displayed by the sun mark 22 in the sun state display 710 and the time corresponding to the state or position of the sun can be displayed similar to the wrist watch 1 in the embodiment described above.

Further, in the existing wrist watch including the 24-hour time display which displays time in the 24-hour format, the sun state display 710 is configured to include the rotary disk 730 instead of pointers or needles rotating about the center C3, and the small dial 720 which is formed by adding the sun mark 22, the moon mark 23 and the masking band 733 to the existing small dial of the 24-hour time display. Accordingly, it is unnecessary to use a single-purpose or dedicated movement as the movement of the sun state display 710 but the existing general-purpose movement for pointers or needles of the 24-hour time display can be used as it is.

Note that the position of the display window 731 in the circumferential direction of the masking band 733 is not limited to the six o'clock position shown in FIG. 13B, but may be the twelve o'clock position, the three o'clock position, the nine o'clock position or other positions. In this case, the positions of the numbers 21 in the rotary disk 730 correspond to the position of the display window 731.

Figure 14A:
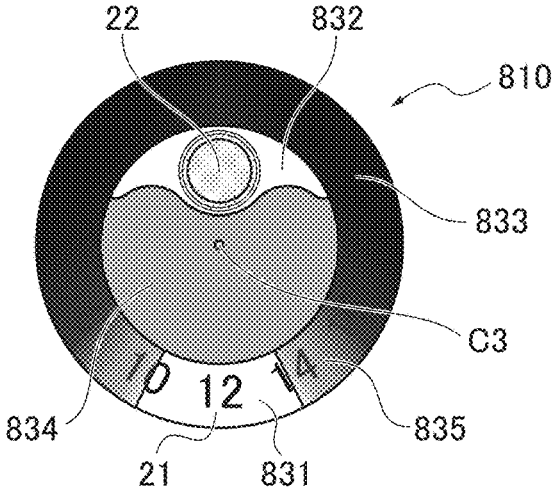
FIG. 14A is a plan view illustrating a sun state display replaced from the sun state display in the wrist watch shown in FIG. 13A.
Figure 14B:
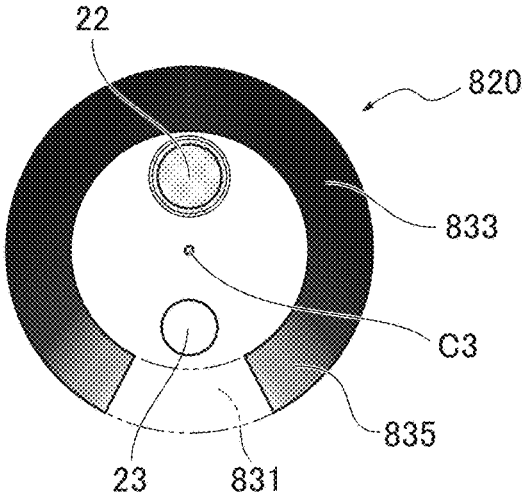
FIG. 14B is a plan view illustrating a small dial in the sun state display shown in FIG. 14A.
Figure 14C:
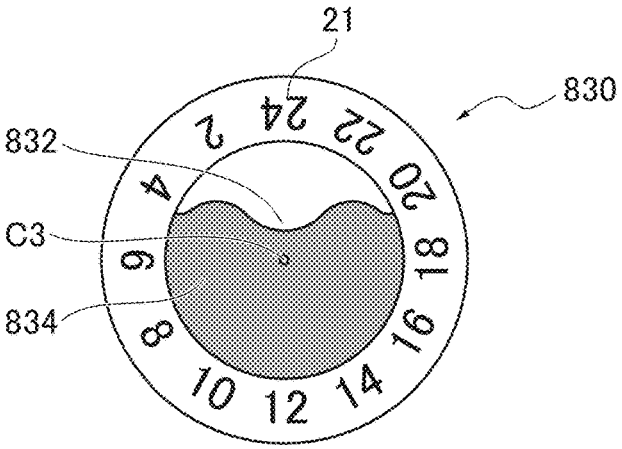
FIG. 14C is a plan view illustrating a rotary disk in the sun state display shown in FIG. 14A.

(Ninth Variation) FIG. 14A is a plan view illustrating a sun state display 810 in the wrist watch 1 replaced from the sun state display 710. FIG. 14B is a plan view illustrating a small dial 820 in the sun state display 810 shown in FIG. 14A. FIG. 14C is a plan view illustrating a rotary disk 830 in the sun state display 810 shown in FIG. 14A.

The wrist watch 1 includes the sun state display 810 shown in FIG. 14A replaced from the sun state display 710 in the wrist watch 1 shown in FIG. 13A. The wrist watch 1 including the sun state display 810 is also one embodiment of the timepiece according to the present disclosure. The sun state display 810 shown in FIG. 14A includes the small dial 820 replaced from the small dial 720, and the rotary disk 830 replaced from the rotary disk 730. The small dial 820 may be made of metal or resin. As shown in FIG. 14B, the small dial 820 includes the sun mark 22, the moon mark 23 opposite to the sun mark 22 across the center C3, and a colored masking band 833 radially outward of the sun mark 22. The masking band 833 is an arc band.

The masking band 833 is basically same as the masking band 733 in the small dial 720 shown in FIG. 13B. However, the masking band 833 includes a display window 831 replaced from the display window 731. Each end of the masking band 833 close to the display window 831 has a gradation 835. The color of the gradation 835 gradually changes as it approaches the display window 831 so that the color of the masking band 833 becomes similar to the color of the display window 831.

The rotary disk 830 is made of transparent resin, grass or the like. The rotary disk 830 is disposed over the small dial 820 and rotates about the center C3 in the clockwise direction in the 24-hour period. The rotary disk 830 has a basic configuration substantially same as the rotary disk 730 shown in FIG. 13C. As shown in FIG. 14C, the rotary disk 830 includes the twelve numbers 21 (i.e. 2, 4, . . . , 22, 24 corresponding to time in the 24-hour format). The twelve numbers 21 are radially provided in an area overlapped by the masking band 833 of the small dial 820 and arranged at equal intervals (an interval by 30 [degrees] of the rotation angle about the center C3) in the counterclockwise direction in the above order.

Further, the rotary disk 830 includes a background 834 radially inward of the numbers 21. The background 834 is circular and dark-colored. The background 834 is colored in a color such that the sun mark 22 cannot be visually recognized when the sun mark 22 overlaps the background 834. The background 834 may have the same color as the sun mark 22 or may have an opaque color. Accordingly, only the background 834 may be made of metal or by opaque printing.

The background 834 includes a display window 832 for the sun mark 22. The display window 832 exposes the sun mark 22 only in a predetermined rotation angle of the rotary disk 830 when the small dial 820 overlaps the rotary disk 830 with the common center C3. Specifically, the display window 832 is an opening (hole) extending through the rotary disk 830. However, the display window 832 may be an uncolored and transparent portion of the circular background 834.

According to the wrist watch 1 including the sun state display 810 configured as above, the state or position of the sun can be intuitively and directly displayed by the sun mark 22 in the sun state display 810 and the time corresponding to the state or position of the sun can be displayed similar to the wrist watch 1 described above.

Further, in the existing wrist watch including the 24-hour time display which displays time in the 24-hour format, the sun state display 810 can be configured by providing the rotary disk 830 instead of pointers or needles rotating about the center C3, and the small dial 820 which is formed by adding the sun mark 22, the moon mark 23 and the masking band 833 to the existing small dial of the 24-hour time display. Accordingly, it is unnecessary to use a single-purpose or dedicated movement as the movement of the sun state display 810, but the existing general-purpose movement for the pointers or needles of the 24-hour time display can be used as it is.

Moreover, the sun state display 810 can gradually expose, from the gradation 835, one of two numbers 21 adjacent to the number 21 exposed through the display window 831. Similarly, the sun state display 810 can gradually hide, by the gradation 835, the other of the two numbers 21 adjacent to the number 21 exposed through the display window 831.

Figure 15A:
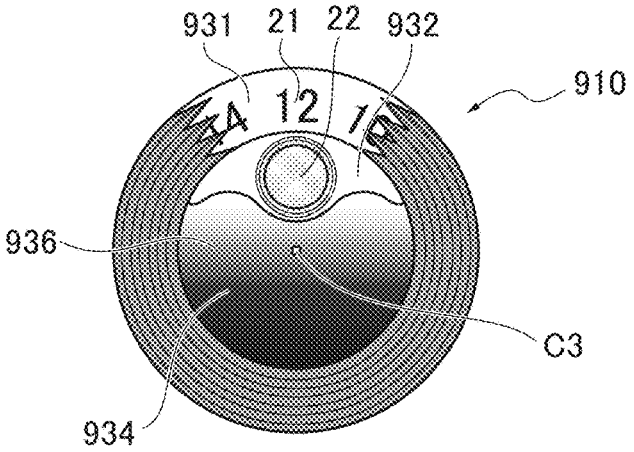
FIG. 15A is a plan view illustrating a sun state display replaced from the sun state display in the wrist watch shown in FIG. 13A.
Figure 15B:
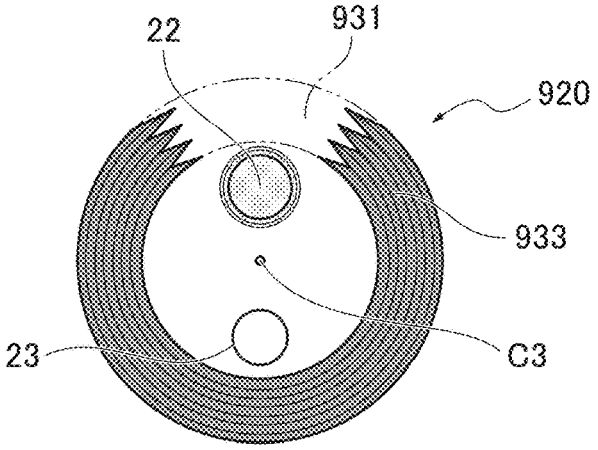
FIG. 15B is a plan view illustrating a small dial in the sun state display shown in FIG. 15A.
Figure 15C:
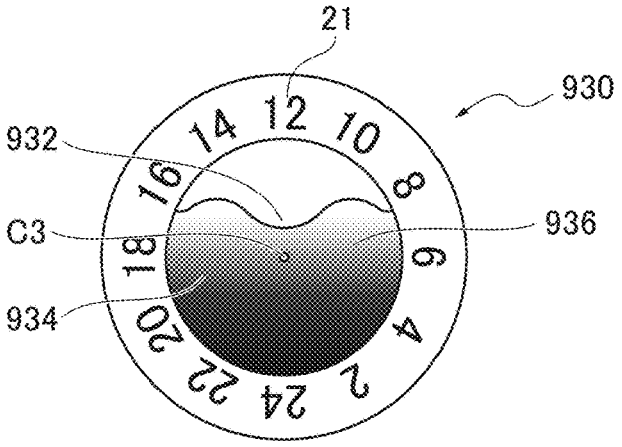
FIG. 15C is a plan view illustrating a rotary disk in the sun state display shown in FIG. 15A.

(Tenth Variation) FIG. 15A is a plan view illustrating a sun state display 910 in the wrist watch 1 replaced from the sun state display 710. FIG. 15B is a plan view illustrating a small dial 920 in the sun state display 910 shown in FIG. 15A. FIG. 15C is a plan view illustrating a rotary disk 930 in the sun state display 910 shown in FIG. 15A.

The wrist watch 1 includes the sun state display 910 shown in FIG. 15A replaced from the sun state display 710 in the wrist watch 1 shown in FIG. 13A. The wrist watch 1 including the sun state display 910 is also one embodiment of the timepiece according to the present disclosure. The sun state display 910 shown in FIG. 15A includes the small dial 920 replaced from the small dial 720, and the rotary disk 930 replaced from the rotary disk 730. The small dial 920 may be made of metal or resin. As shown in FIG. 15B, the small dial 920 includes the sun mark 22, the moon mark 23 opposite to the sun mark 22 across the center C3, and a colored masking band 933 radially outward of the sun mark 22. The masking band 933 is an arc band.

The masking band 933 is basically same as the masking band 733 in the small dial 720 shown in FIG. 13B. However, the masking band 933 includes a plurality of grooves 938 (see FIG. 16B described below). The grooves 938 are concentrically formed on the surface of the masking band 933 and filled with a plating or coating so that the numbers 21 in the overlapped rotary disk 930 cannot be visually recognized. A method for forming the masking band 933 will be described in detail below. The masking band 933 includes a display window 931 replaced from the display window 731. The grooves 938 in each end of the masking band 933 close to the display window 931 are shallower and narrower than the grooves 938 in the other area of the masking band 933. Accordingly, the colored condition by the ink filled in the grooves 938 in each end of the masking band 933 becomes lighter than that those in the other area, which achieves an effect similar to the gradation 835 in the masking band 833 shown in FIG. 14B.

The rotary disk 930 is made of transparent resin, grass or the like. The rotary disk 930 is disposed over the small dial 920 and rotates about the center C3 in the clockwise direction in the 24-hour period. The rotary disk 930 has a substantially same configuration as the rotary disk 730 shown in FIG. 13C or the rotary disk 830 shown in FIG. 14C. As shown in FIG. 15C, the rotary disk 830 includes the twelve numbers 21 (i.e. 2, 4, . . . , 22, 24 corresponding to time in the 24-hour format). The twelve numbers 21 are radially provided in an area overlapped by the masking band 933 of the small dial 920 and arranged at equal intervals (an interval by 30 [degrees] of the rotation angle about the center C3) in the counterclockwise direction in the above order.

Further, the rotary disk 930 includes a background 934 radially inward of the numbers 21. The background 930 is circular and dark-colored. The background 934 is colored in a color such that the sun mark 22 cannot be visually recognized when the sun mark 22 overlaps the background 934. The background 934 includes a display window 932 for the sun mark 22. The display window 932 exposes the sun mark 22 only in a predetermined rotation angle of the rotary disk 930 when the small dial 920 overlaps the rotary disk 930 with the common center C3. Specifically, the display window 932 may be an opening (hole) extending through the rotary disk 930 or an uncolored and transparent portion of the circular background 934 so that the sun mark 22 can be seen therethrough.

As the color which makes the sun mark 22 visually unrecognized, the background 934 may have the same color as the sun mark 22 or may have an opaque color. The background 934 includes a gradation 936 in a portion close to the display window 932.

Figure 16A:
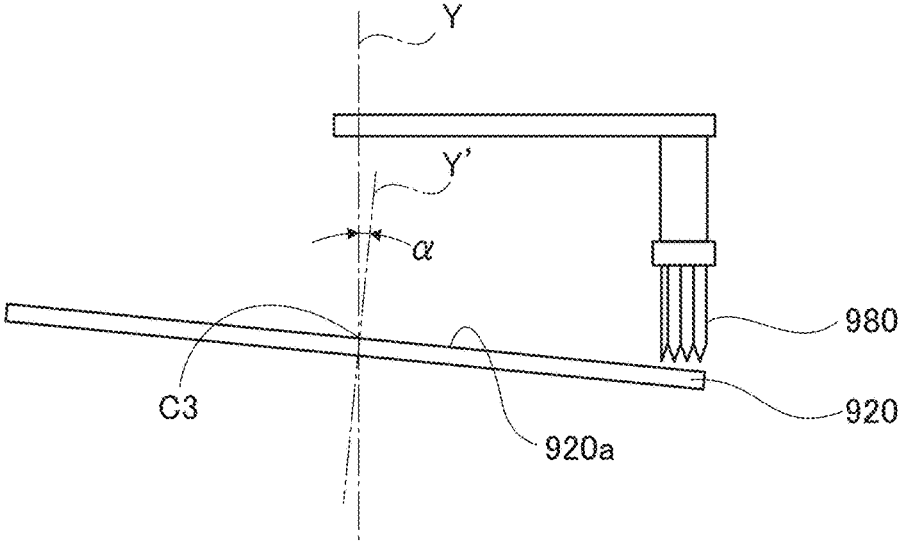
FIG. 16A is a side view illustrating a method for forming grooves of a masking band in the small dial.
Figure 16B:
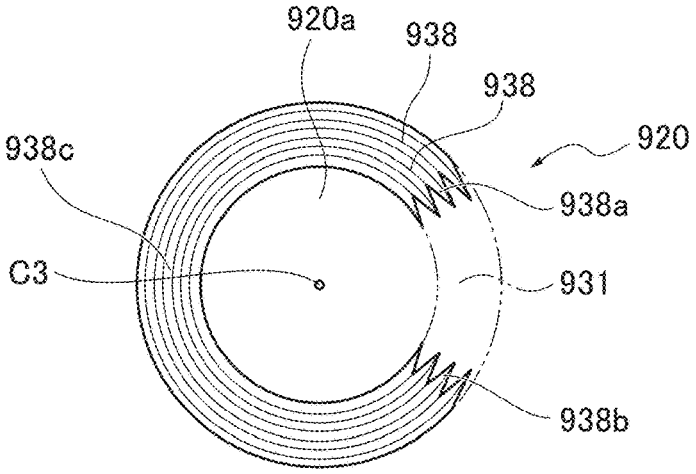
FIG. 16B is a plan view illustrating the small dial with the grooves which are formed by the method shown in FIG. 16A.
Figure 16C:
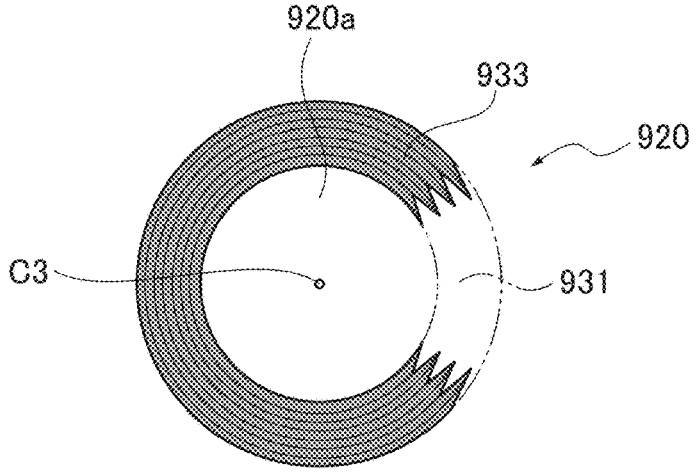
FIG. 16C is a plan view illustrating the small dial including a masking band in which the grooves shown in FIG. 16B are filled with plating and colored.

FIG. 16A is a side view illustrating a method for forming the grooves 938 of the masking band 933 in the small dial 920. FIG. 16B is a plan view illustrating the small dial 920 with the grooves 938 formed by the method shown in FIG. 16A. FIG. 16C is a plan view illustrating the small dial 920 including the masking band 933 by filling a plating or coating in the grooves 938 and colored shown in FIG. 16B.

The masking band 933 of the small dial 920 described above may be formed by a method which will be described below, for example. Specifically, as shown in FIG. 16A, the small dial 920 is fixedly supported. A brush 980 is disposed to extend parallel to the rotation axis Y and rotate about the rotation axis Y. The rotation axis Y is inclined in a predetermined angle (5 to 10 [degrees], for example) relative to an axis Y' which extends through the center C3 of the small dial 920 and is orthogonal to the surface 920*a* of the small dial 920.

The brush 980 is disposed in an area corresponding to the radially outer side of the small dial 920, and the tip of the brush 980 is placed in a position away from the lowest position of the small dial 920 in a posture where the rotation axis Y is in the vertical direction. The tip of the brush 980 contacts the surface 920*a* of the small dial 920 while the brush 980 rotates once about the rotation axis Y. As shown in FIG. 16B, the tip of the brush 980 contacts the surface 920*a* and moves along the surface 920*a* in accordance with the rotation of the small dial 920, and accordingly, the concentric grooves 938 are formed in the surface 920*a*.

In FIG. 16B, a portion corresponding to the radially outer side of the surface 920*a* of the small dial 920 and including no concentric grooves 938 is the lowest position in the small dial 920 along the rotation axis Y and accordingly the brush 980 does not contact this portion. The portion including no grooves 938 becomes the display window 931.

The grooves 938 are shallower and narrower in a portion 938*a* where the contact of the brush 980 starts and in a portion 938*b* where the contact of the brush 980 ends. On the other hand, the grooves 938 are deeper and wider in portions where the contact of the brush 980 progresses from the portion 938*a* where the contact of the brush 980 starts. Note that in this example, the grooves 938 is the deepest and the widest in a portion 938*c* which is in a highest position along the Y-axis direction. Then, the small dial 920 including the concentric grooves 938 is colored by plating or coating the surface of the grooves 938 to fill the grooves 938. As a result, as shown in FIG. 16C, the masking band 933 is formed with the plating filled in the grooves 938.

As described above, the grooves 938 are shallower and narrower in the both ends of the masking band 933 and accordingly the plating or coating which fills the grooves 938 is thinner and sparser than those in the other portions. Accordingly, the masking effect is lowest in the portion 938*a* where the contact starts and the portion 938*b* where the contact ends while the masking effect is highest in the portion 938*c* in the highest position along the Y-axis direction. Then, gradations in which the masking effect gradually changes are formed between the portion 938*a* where the contact starts and the portion 938*c* in the highest position along the Y-axis direction, and between the portion 938*b* where the contact ends and the portion 938*c*.

Note that the masking band 933 may be formed by filling the plating in embosses in the form of recess instead of the grooves. Accordingly, the recessed portion in which the plating is filled may be formed by embossing such as a press instead of the method forming the concentric grooves 938 shown in FIG. 16A. In this case, it is preferable for the recessed embosses to have a depth similar to that of the grooves 938.

According to the wrist watch 1 including the sun state display 910 configured as above, the sun mark 22 in the sun state display 910 can intuitively and directly display the state or position of the sun and indicate the time corresponding to the state or position of the sun similar to the wrist watch 1 in the embodiment described above.

Further, in the existing wrist watch including the 24-hour time display which displays time in the 24-hour format, the sun state display 910 can be configured by providing the rotary disk 930 instead of needles or pointers rotating about the center C3, and the small dial 920 which is formed by adding the sun mark 22, the moon mark 23 and the masking band 933 to the existing small dial of the 24-hour time display. Accordingly, it is unnecessary to use a single-purpose or dedicated movement as the movement of the sun state display 910 but the existing general-purpose movement for the needles or pointers of the 24-hour time display can be used as it is.

Moreover, the sun state display 910 can gradually expose, from the gradation of the masking band 933, one of two numbers 21 adjacent to the exposed number 21 through the display window 931. Similarly, the sun state display 910 can gradually hide, by the gradation of the masking band 933, the other of the two numbers 21 adjacent to the exposed number 21 through the display window 931.

In each of the seventh to the ninth variations described above, the small dial 720, 820, 920 indicates the number 21 corresponding to the current time by exposing the specific number 21 among the numbers 21 in the rotary disk 730, 830, 930 through the display window 731, 831, 931 of the masking band 733, 833, 933, respectively. However, in the timepiece of the present disclosure, the number 21 corresponding to the current time may be indicated by time indicators each having a configuration other than the display window 731, 831, 931 of the masking band 733, 833, 933.

For example, a mark (triangle ▲, Δ or the like, for example) for pointing out the number 21 may be provided in the vicinity of the center portion in the circumference of the display window 731, 831, 931 shown in FIG. 13B, FIG. 14B, FIG. 15B and radially inward or outward thereof, instead of providing the masking band 733, 833, 933 and the display window 731, 831, 931. Preferably, such a mark is disposed in a position where the mark does not overlap the numbers so as not to hide the numbers. The mark is also an example of the time indicator in the present disclosure. Accordingly, a user can recognize the current time by seeing the number the mark pointed out.

The timepiece of the present disclosure may include the dial having the sun mark for displaying a state or position of the sun, and the rotary member which covers the dial and rotates in the 24-hour period. The rotary member includes a sun state indicator which changes the visibility of the sun mark in accordance with the rotational position of the rotary member. One of the dial and the rotary member may include a plurality of indexes for indicating time, and the other of the dial and the rotary member may include a time indicator which indicates one of the indexes in accordance with the rotational position of the rotary member. The time indicator and the sun state indicator may be disposed relative to each other in a positional relationship such that a visibility of the sun mark by the sun state indicator corresponds to the state or position of the sun at the time corresponding to one of the indexes indicated by the time indicator. The timepiece of the present disclosure is not limited to the above embodiment and the variations.

The timepiece of the present disclosure is not limited to the wrist watch shown in the embodiments, but may be adapted to various timepieces such as a clock, a wall clock, a pocket watch and the like.

The invention claimed is:

1. A timepiece comprising:

a dial comprising a sun mark for displaying a state of the sun; and a rotary member that covers the dial and is configured to rotate one rotation in a 24-hour period, the rotary member comprising a sun state indicator that changes a visibility of the sun mark in accordance with a rotational position of the rotary member, wherein the sun state indicator comprises a display window that changes the visibility of the sun mark by changing a level of exposure of the sun mark through the display window in accordance with the rotational position of the rotary member, and wherein the level of the exposure of the sun mark represents the state of the sun, wherein one of the dial and the rotary member comprises a plurality of indexes for indicating time, and the other of the dial and the rotary member comprises a time indicator that indicates one of the indexes in accordance with the rotational position of the rotary member, and wherein the time indicator comprises a second display window that exposes one of the indexes corresponding to current time, and wherein the time indicator and the sun state indicator are disposed relative to each other in a positional relationship such that the visibility of the sun mark through the sun state indicator corresponds to the state of the sun at a time corresponding to one of the indexes indicated by the time indicator.

2. The timepiece according to claim 1, wherein the time indicator and the sun state indicator are disposed in opposite areas across a rotation center of the rotary member.

3. The timepiece according to claim 1, wherein the indexes are arranged radially outward of the sun mark along a circumference of the dial.

4. The timepiece according to claim 1, further comprising a time indicator that indicates time in a 12-hour format by indexes that rotate about a center of the timepiece, and wherein each of the dial and the rotary member is disposed in a position eccentric from the center of the timepiece.

5. The timepiece according to claim 1, wherein the dial comprises a moon mark that represents a moon in a position opposite to the sun mark across a center of the dial, and wherein the rotary member comprises a moon indicator that changes a visibility of the moon mark in accordance with the rotational position.

6. The timepiece according to claim 5, wherein the sun mark comprises a shape that is different from a shape of the moon mark.

7. The timepiece according to claim 1, wherein the dial comprises the indexes and the rotary member comprises the time indicator.

8. The timepiece according to claim 1, wherein the rotary member comprises the indexes and the dial comprises the time indicator.

9. The timepiece according to claim 1, wherein the dial is fixed and does not rotate.

* * * * *